US010119692B2

(12) United States Patent
Chang et al.

(10) Patent No.: US 10,119,692 B2
(45) Date of Patent: Nov. 6, 2018

(54) LIGHTING DEVICE

(71) Applicant: LG ELECTRONICS INC., Seoul (KR)

(72) Inventors: Hyeuk Chang, Seoul (KR); Daehyuk Lee, Seoul (KR); Moonsung Cho, Seoul (KR); Sangchul Han, Seoul (KR); Jinsung Kwak, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 337 days.

(21) Appl. No.: 14/991,504

(22) Filed: Jan. 8, 2016

(65) Prior Publication Data

US 2016/0223176 A1 Aug. 4, 2016

(30) Foreign Application Priority Data

Feb. 2, 2015 (KR) ..... 10-2015-0016297
Feb. 2, 2015 (KR) ..... 10-2015-0016298

(51) Int. Cl.

| | |
|---|---|
| ***F21V 23/02*** | (2006.01) |
| ***F21V 31/00*** | (2006.01) |
| ***F21S 8/08*** | (2006.01) |
| ***F21V 23/00*** | (2015.01) |
| ***F21V 29/74*** | (2015.01) |

(Continued)

(52) U.S. Cl.

CPC ..... *F21V 23/023* (2013.01); *F21S 8/085* (2013.01); *F21V 23/001* (2013.01); *F21V 23/008* (2013.01); *F21V 23/06* (2013.01); *F21V 29/10* (2015.01); *F21V 29/74* (2015.01); *F21V 31/005* (2013.01); *F21Y 2105/10* (2016.08); *F21Y 2115/10* (2016.08)

(58) Field of Classification Search

CPC .... F21V 23/023; F21V 23/001; F21V 23/008; F21V 23/06; F21V 29/10; F21V 29/74; F21V 31/005; F21S 8/085; F21Y 2105/10; F21Y 2115/10

See application file for complete search history.

(56) References Cited

U.S. PATENT DOCUMENTS 3,754,121 A * 8/1973 Delay ..... G01P 3/489 324/166
5,526,236 A * 6/1996 Burnes ..... G09F 13/04 257/E25.028

(Continued)

FOREIGN PATENT DOCUMENTS

CN 202511075 U 10/2012

*Primary Examiner* — Mary Ellen Bowman

(74) *Attorney, Agent, or Firm* — Birch, Stewart, Kolasch & Birch, LLP

(57) ABSTRACT

A lighting device includes a housing, at least one light source module disposed on a back surface of the housing, and a power section casing located at an upper portion of the housing, and accommodating a power unit for controlling and supplying power to the light source module. The power section casing is divided into a power section region for accommodating the power unit and at least one junction region for providing a space in which the power unit is electrically connected to an external power source. The junction region includes therein a cable fixing section for fixing an external power source cable connected to the external power source, and a ground section electrically connected to the power unit.

19 Claims, 20 Drawing Sheets

(51) Int. Cl.

| | |
|---|---|
| ***F21V 23/06*** | (2006.01) |
| ***F21V 29/10*** | (2015.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 2005/0128752 | A1* | 6/2005 | Ewington | F21V 29/004 362/294 |
| 2006/0050507 | A1* | 3/2006 | Morrow | B64F 1/20 362/227 |
| 2007/0242461 | A1* | 10/2007 | Reisenauer | F21V 25/10 362/294 |
| 2008/0310162 | A1* | 12/2008 | Thomas | F21V 15/01 362/249.01 |
| 2009/0021936 | A1* | 1/2009 | Stimac | F21S 2/005 362/249.02 |
| 2010/0157610 | A1 | 6/2010 | Xiao et al. | |
| 2010/0295468 | A1* | 11/2010 | Pedersen | F21S 10/02 315/294 |
| 2011/0075414 | A1* | 3/2011 | Van De Ven | F21V 15/01 362/235 |
| 2012/0287613 | A1 | 11/2012 | Hamel et al. | |
| 2013/0083529 | A1* | 4/2013 | Gifford | F21V 21/03 362/249.02 |
| 2013/0135866 | A1* | 5/2013 | Souvay | F21K 9/00 362/249.02 |
| 2014/0049957 | A1* | 2/2014 | Goelz | F21V 29/763 362/235 |
| 2014/0268801 | A1* | 9/2014 | Madden | F21S 8/026 362/294 |

* cited by examiner

LIGHTING DEVICE

CROSS-REFERENCE TO RELATED APPLICATION

This application claims the priority benefit of Korean Patent Application Nos. 10-2015-0016297 and 10-2015-0016298, filed on Feb. 2, 2015, in the Korean Intellectual Property Office, the entire disclosures of which are hereby incorporated by reference herein.

BACKGROUND OF THE INVENTION

Field of the Invention

Exemplary embodiments of the present invention relate to a lighting device.

Description of the Related Art

In general, light bulbs or fluorescent lamps are commonly used as indoor or outdoor lighting. However, these light bulbs or fluorescent lamps have a short life and thus have to be frequently replaced. In addition, a phenomenon in which the illuminance of the conventional fluorescent lamps is gradually lowered due to degradation caused over time may excessively occur.

In order to address these problems, various lighting modules employing LEDs (Light Emitting Diodes) capable of realizing improved control characteristics, a fast response speed, high electrophotic conversion efficiency, a long life, low power consumption, and high luminance and emotional lighting characteristics, have been developed.

LEDs are a type of semiconductor device for converting electric energy into light. The LEDs have advantages of low power consumption, a semi-permanent life, a rapid response speed, safety, and environment friendliness, compared to existing light sources such as fluorescent lamps and incandescent lamps. For this reason, much research for substituting the existing light sources with the LEDs is ongoing. The LEDs are now increasingly used as light sources for various lighting devices such as liquid crystal display devices, electric sign boards, and street lamps used in the interior and exterior.

However, a lighting device using light emitting elements has a structure in which wiring is complicated and exposed to the outside since a power unit is located at an upper portion of a housing or at a side of the lighting device, and thus wiring work is difficult and exposed to electric danger.

In addition, when a plurality of light source modules is used in the lighting device, it is difficult to wire the light source modules.

Furthermore, when the light source modules are connected to each other, it is difficult to address waterproof problems together with the wiring.

Since the light emitting elements are easily damaged by heat in the lighting device using the same, research for efficiently dissipating heat generated by the light emitting elements is ongoing.

SUMMARY OF THE INVENTION

Therefore, the present invention has been made in view of the above problems, and it is an object of the present invention to provide a lighting device in which a power unit spaced apart from a housing is easily electrically connected to a light source module and sealing therebetween is easily performed.

In addition, it is another object of the present invention to provide a lighting device having improved heat dissipation performance.

In accordance with an aspect of the present invention, the above and other objects can be accomplished by the provision of a lighting device including a housing, at least one light source module disposed on a back surface of the housing, and a power section casing located at an upper portion of the housing, and accommodating a power unit for controlling and supplying power to the light source module, wherein the power section casing is divided into a power section region for accommodating the power unit and at least one junction region for providing a space in which the power unit is electrically connected to an external power source, and the junction region includes therein a cable fixing section for fixing an external power source cable connected to the external power source, and a ground section electrically connected to the power unit.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1A:
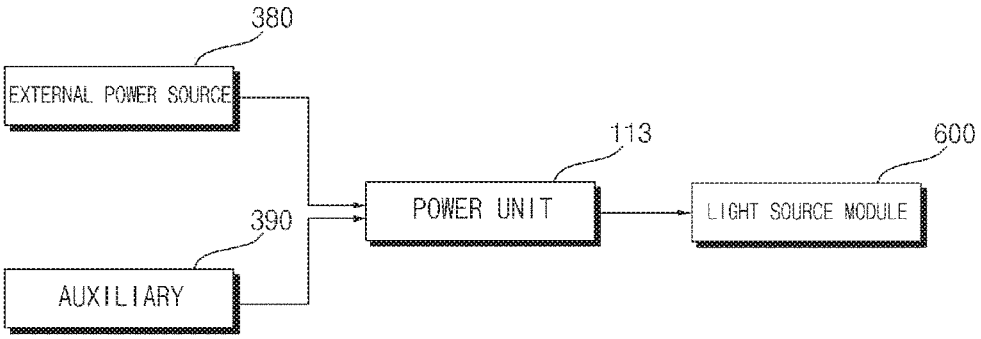
FIG. 1A is a conceptual view illustrating power connection of a lighting device according to an embodiment of the present invention.
Figure 1B:
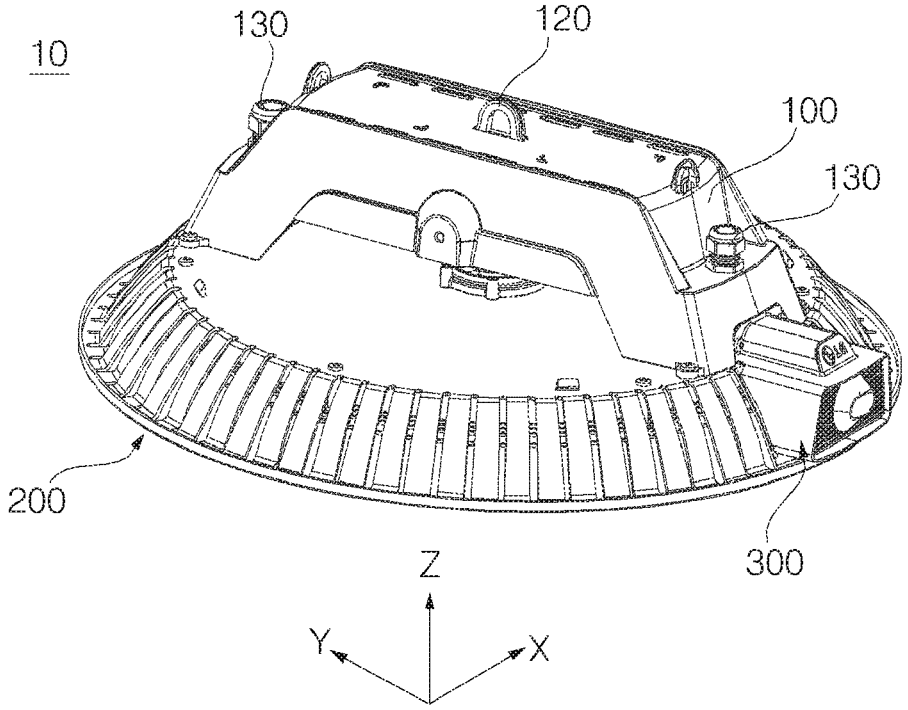
FIG. 1B is a perspective view illustrating the lighting device according to the embodiment of the present invention.
Figure 2:
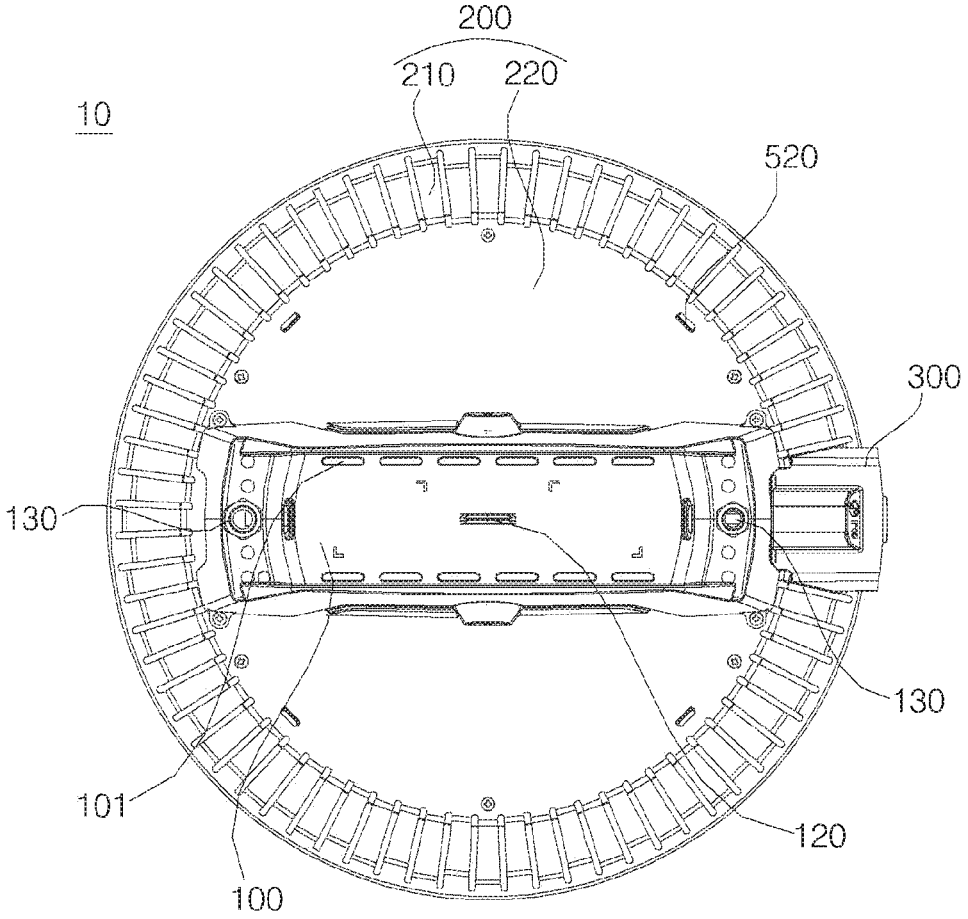
FIG. 2 is a top view illustrating the lighting device according to the embodiment of the present invention.
Figure 3:
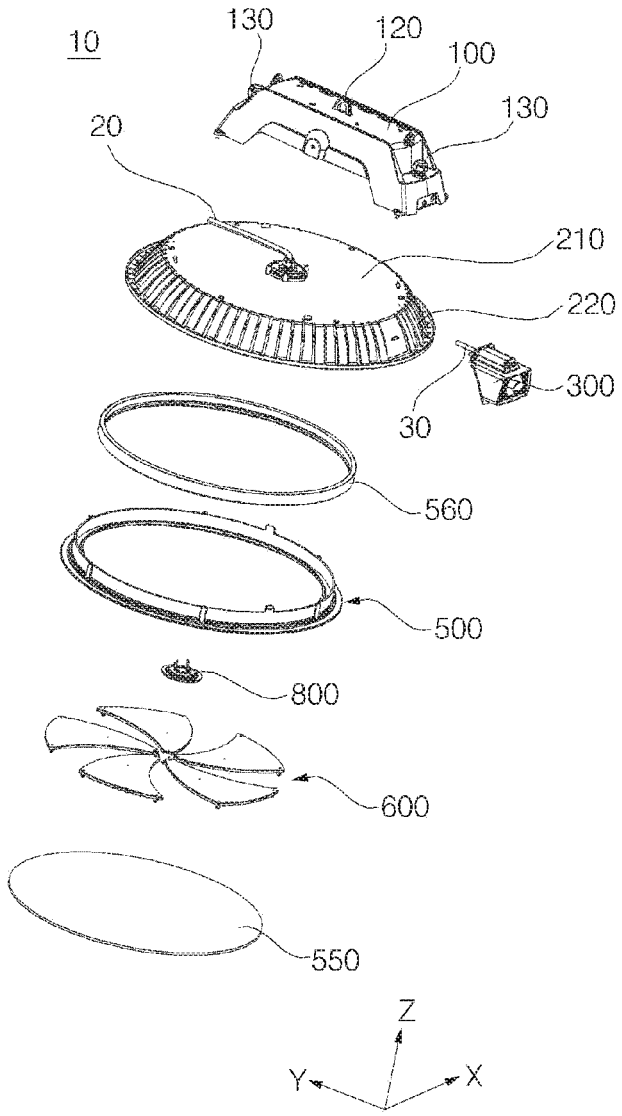
FIG. 3 is an exploded perspective view illustrating the lighting device according to the embodiment of the present invention.

FIG. 1A is a conceptual view illustrating power connection of a lighting device according to an embodiment of the present invention. FIG. 1B is a perspective view illustrating the lighting device according to the embodiment of the present invention. FIG. 2 is a top view illustrating the lighting device according to the embodiment of the present invention. FIG. 3 is an exploded perspective view illustrating the lighting device according to the embodiment of the present invention.

A lighting device 10 according to an embodiment includes a housing 200, at least one light source module 600 (see FIG. 7) disposed on a back surface of the housing 200, a power section casing 100 which accommodates a power unit 113 for supplying power to the light source module 600, and an auxiliary casing 300 which accommodates an auxiliary connector 320 (see FIG. 12) electrically connected to the power unit 113. As used herein, the elements identified as auxiliary are generally considered to be provided optionally.

Referring to FIGS. 1 to 3, in the lighting device 10 according to the embodiment, an AC current is supplied from an external power source 380 to the power unit 113, and the supplied AC current is converted into a DC current in the power unit 113 and is then output to the light source module 600. In addition, the power unit 113 is electrically connected to an auxiliary unit 390 and receives control signals, sensing signals, and the like generated by the auxiliary unit 390.

For example, the auxiliary unit 390 includes one of a communication module, a sensor module, and a control module.

The power unit 113 supplies power to the light source module 600. Specifically, the power unit 113 controls an overall operation of the lighting device and supplies actuating power to the light source module 600.

For example, the power unit 113 generates and outputs actuating power and control signals and is accommodated in the power section casing 100.

The power unit 113 generates actuating power supplied to the light source module 600 and control signals. The power unit 113 may include a main substrate and a plurality of components. The main substrate may be a printed circuit board. The components are mounted on and electrically connected to the main substrate.

In addition, the power unit 113 may be a PSU (Power Supply Unit). In this case, the power unit 113 may control the light source module 600 according to wireless control signals received from the auxiliary unit 390.

The power section casing 100 accommodates the power unit 113. A support member 120 for fixing the power section casing 100 in an external space is provided on an outer surface of the power section casing 100. In addition, the power section casing 100 has vent holes 101 through which outside air passes for cooling of the power unit 113.

The power unit 113 is spaced apart from the housing 200. This enables the light source module 600 to be prevented from overheating due to transfer of heat generated by the power unit 113 to the light source module 600.

Specifically, the power unit 113 is arranged on an upper portion of the housing 200 to be spaced apart from the housing 200. Detailed description of the power section casing 100 will be given later.

Here, the upward direction refers to a Z-axis direction and the downward direction refers to a direction opposite to the Z-axis direction. In addition, the lateral direction refers to an X- or Y-axis direction perpendicular to the Z-axis direction.

Figure 4:
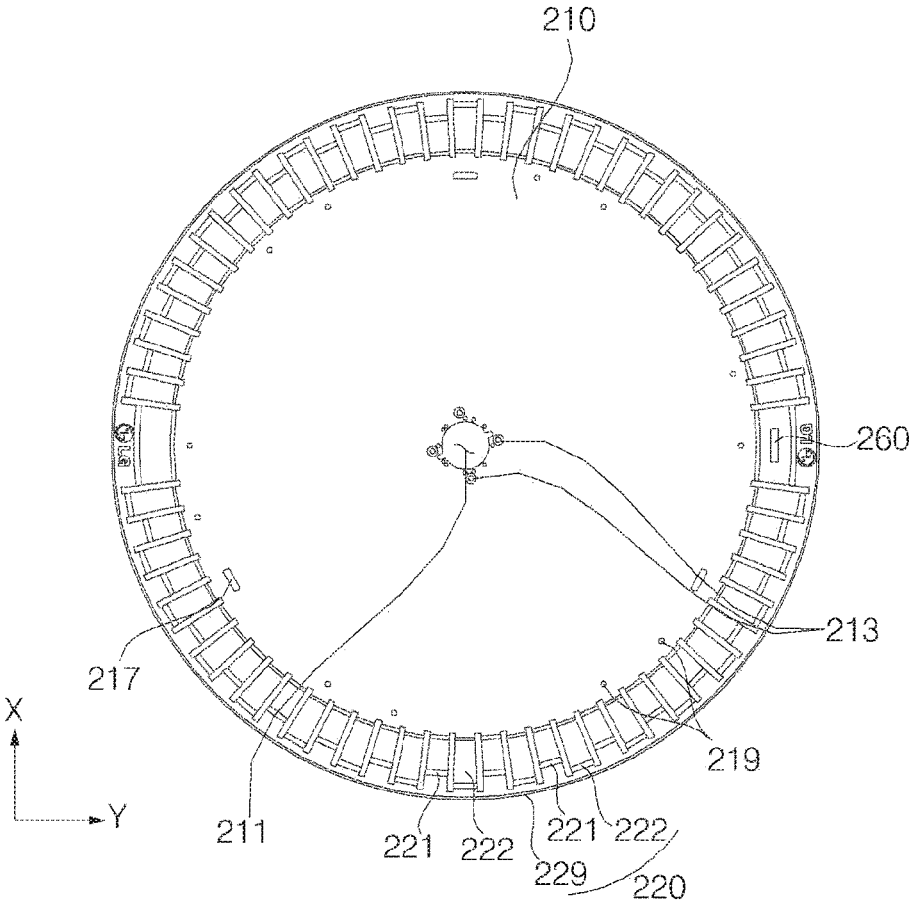
FIG. 4 is a top view illustrating a housing according to the embodiment of the present invention.

The housing 200 has a power connection hole 211 (see FIG. 4). A light source cable 20 electrically connecting the power unit 113 to the light source module 600 passes through the housing 200. The housing 200 defines a space in which the light source module 600 is located. In addition, the housing 200 serves to dissipate heat.

Hereinafter, the housing 200 will be described in detail with reference to the drawings.

Figure 5:
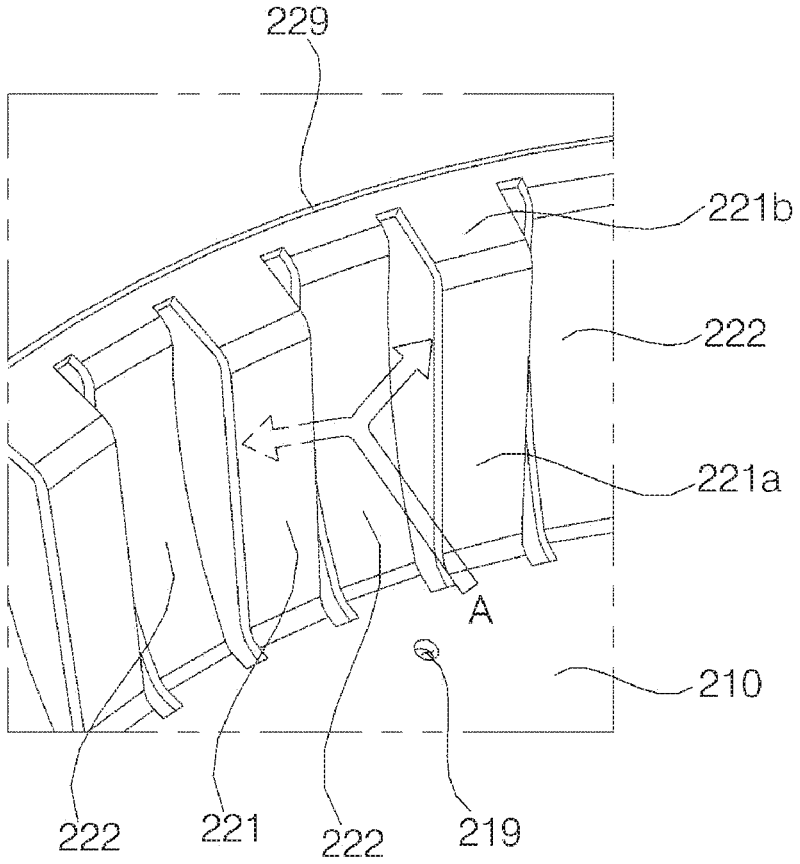
FIG. 5 is a perspective view illustrating a heat dissipation section of the housing according to the embodiment of the present invention.
Figure 6:
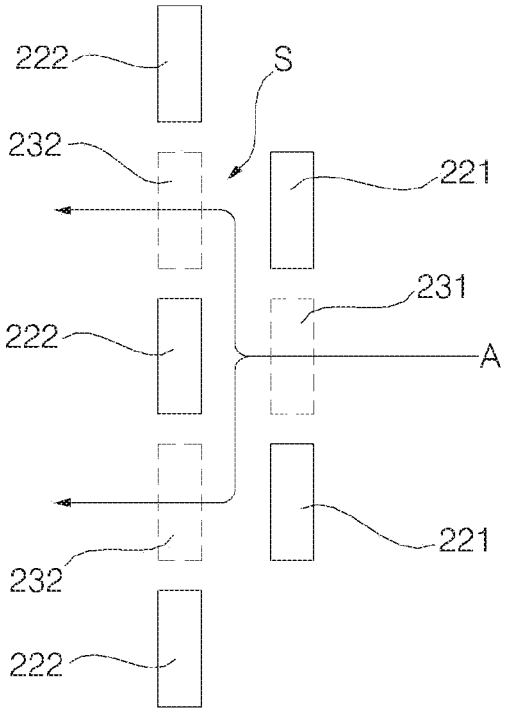
FIG. 6 is a cross-sectional view illustrating the heat dissipation section of the housing according to the embodiment of the present invention.

FIG. 4 is a top view illustrating the housing according to the embodiment of the present invention. FIG. 5 is a perspective view illustrating a heat dissipation section of the housing according to the embodiment of the present invention. FIG. 6 is a cross-sectional view illustrating the heat dissipation section of the housing according to the embodiment of the present invention.

Referring to FIGS. 4 to 6, the housing 200 has the power connection hole 211 formed at the center thereof, and provides a space for coupling of the light source module 600 around the power connection hole 211.

For example, the housing 200 includes a base plate 210 and a heat dissipation section 220.

The base plate 210 and the heat dissipation section 220 are integrally formed, and each of them is made of a metal material such as aluminum having high conductivity.

In particular, the housing 200 may be made of a plate material for maximization of thermal conductivity.

The base plate 210 has the power connection hole 211 formed at the center thereof, and a space in which the light source module 600 is located is defined around the power connection hole 211. Specifically, the base plate 210 may have a circular shape on the plane (X-Y axis plane).

The base plate 210 has a plurality of hook holes 217 circumferentially formed at an edge thereof. A hook 520 (see FIG. 10) of a front cover 500 is fastened through each of the hook holes 217. In particular, the hook hole 217 is arranged outside the light source module 600 on the plane.

In addition, the base plate 210 may have a plurality of bolt holes 219 circumferentially formed at the edge thereof. A bolt passing through the front cover 500 is coupled to the associated bolt hole 219. In addition, a bolt passing through the power section casing 100 is coupled to the associated bolt hole 219.

Of course, the hook hole 217 and the bolt hole 219 are preferably located outside a region in which the light source module 600 is located in the base plate 210, for waterproofing.

A sealing ring 560 (see FIG. 10) is disposed inside the hook hole 217 and the bolt hole 219 so as to surround the light source module 600. Since the hook hole 217 and the bolt hole 219 are located outside the sealing ring 560, water is prevented from being introduced into the light source module 600 from the outside.

Referring to FIGS. 5 and 6, the heat dissipation section 220 dissipates heat transferred from the base plate 210.

The heat dissipation section 220 is arranged to surround the edge of the base plate 210, and includes first and second radiation fins 221 and 222 arranged in a circumferential direction of the housing 200.

A plurality of first radiation fins 221 is circumferentially arranged. Each second radiation fin 222 is located between the two adjacent first radiation fins 221.

Here, when natural convection occurs, outside air flows through a first radiation space 231 between each first radiation fin 221 and another first radiation fin 221 adjacent thereto, a space S between each first radiation fin 221 and each second radiation fin 222 associated therewith, and a second radiation space 232 between each second radiation fin 222 and another second radiation fin 222 adjacent thereto.

A residence time and a flow path A of outside air and a heat exchange area for convection are increased through the structure of the heat dissipation section 220 as described above.

Specifically, each first radiation space 231 may be arranged between the adjacent two first radiation fins 221 and each second radiation space 232 may be arranged between the adjacent two second radiation fins 222.

That is, the first radiation fins 221 may be respectively arranged so as to be spaced apart from each other by a predetermined distance in the circumferential direction of the housing 200, and the second radiation fins 222 may be respectively arranged so as to be spaced apart from each other by a predetermined distance in the circumferential direction of the housing 200.

Here, it is preferable that each of the first radiation spaces 231 is located to face the associated second radiation fin 222 and each of the second radiation spaces 232 is located to face the associated first radiation fin 221.

The outside air introduced into the first radiation spaces 231 collides with the second radiation fins 222, and thus the flow path A may be bent once. The outside air may flow to the space S between the first and second radiation fins 221 and 222 and then be discharged through the second radiation spaces 232 to the outside.

Meanwhile, the outside air may be branched into both sides in the space S between the first and second radiation fins 221 and 222.

Accordingly, the flow path A of the outside air may be changed when the outside air passes through the heat dissipation section 220, and particularly, the flow path A of the outside air may be bent twice or more when the outside air passes through the heat dissipation section 220. As such, a residence time of outside air and a heat exchange area for convection may be increased by complicatedly forming the flow path A.

Each of the first and second radiation fins 221 and 222 may extend from the base plate 210.

In particular, each of the first and second radiation fins 221 and 222 may extend from the base plate 210 so as to have a predetermined curvature, and the first and second radiation fins 221 and 222 may extend from the base plate 210 while having a different curvature.

In addition, the first and second radiation fins 221 and 222 may have a curvature so as to protrude in different directions. That is, the second radiation fin 222 may protrude toward the power unit 113 unlike the first radiation fin 221.

The first and second radiation fins 221 and 222 may form a plurality of holes by a certain pitch at the edge of the housing 200 made of a plate material in the circumferential direction of the housing 200, the holes defining the first and second radiation fins 221 and 222, and the first and second radiation fins 221 and 222 may be formed so as to protrude in different directions.

In addition, the heat dissipation section 220 is provided with a rim portion 229 connected to the first radiation fins 221 extending from the base plate 210 and the second radiation fins 222 extending from the base plate 210.

Specifically, the rim portion 229 forms an outer edge of the heat dissipation section 220 and is connected to outer ends of the first and second radiation fins 221 and 222.

The rim portion 229 maintains the shapes of the first and second radiation fins 221 and 222 and reinforces the stiffness of the housing 200.

In addition, the rim portion 229 may have improved stiffness through bending in one direction. Specifically, the rim portion 229 is bent toward the power unit 113.

Meanwhile, each of the first radiation fins 221 extends from the base plate 210 and may have a curved portion 221*a* having a predetermined curvature and a flat portion 221*b* bent from the curved portion 221*a*.

That is, the first radiation fin 221 may have a structure protruding in a direction opposite to the power unit 113 according to bending of the curved portion 221*a* and the flat portion 221*b*.

In addition, the flat portion 221*b* may be provided on the same plane as the rim portion 229 of the housing 200.

Each of the first and second radiation fins 221 and 222 may be made of a metal material having high thermal conductivity or a resin material. For example, each of the first and second radiation fins 221 and 222 may be formed by perforating and bending one region in the housing 200 made of an aluminum plate material.

Meanwhile, each of the first and second radiation fins 221 and 222 may have a shape in which a width thereof is gradually enlarged as each extends away from the base plate 210. In this case, the first and second radiation fins 221 and 222 may have the same width.

The power connection hole 211 provides a place in which the light source cable 20 electrically connecting the power unit 113 and the light source module 600 passes. In addition, a cable fastening member accommodating the light source cable 20 is coupled to the power connection hole 211.

In addition, a place for coupling of the light source module 600 and the cable fastening member is provided around the power connection hole 211.

Accordingly, according to the embodiment, the power connection hole 211 and the periphery thereof are sealed, and thus water is prevented from leaking into the power connection hole 211.

The power connection hole 211 is located at the center of the housing 200 when viewed from above. Specifically, the power connection hole 211 is disposed at the center of the base plate 210 while having a shape corresponding to the base plate 210. The power connection hole 211 preferably has a circular shape.

In particular, the power connection hole 211 may have any size, but preferably has a smaller diameter or width than those of the power unit 113 and the housing 200 in consideration of heat transfer and waterproof performance between the power unit 113 and the light source module 600.

When the power connection hole 211 has a smaller size than the power unit 113 and the light source module 600, it may be possible to suppress heat of the power unit 113 from being transferred to the light source module 600 and to seal the power connection hole 211 at low cost.

Meanwhile, a place for coupling of the light source module 600 and the cable fastening member is provided around the power connection hole 211. That is, the periphery of the power connection hole 211 is one region of the base plate 210 forming the edge of the power connection hole 211.

In addition, the base plate 210 has a housing coupling hole 213. A bolt 810 (see FIG. 8B) passing through a female fastening member 243 of the cable fastening member passes through the housing coupling hole 213.

Figure 7:
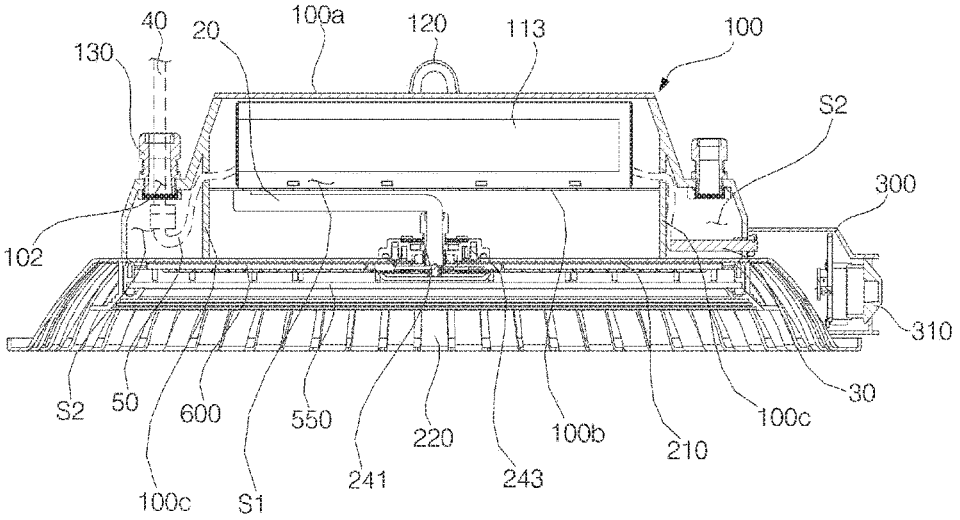
FIG. 7 is a cross-sectional view illustrating the lighting device according to the embodiment of the present invention.
Figure 8A:
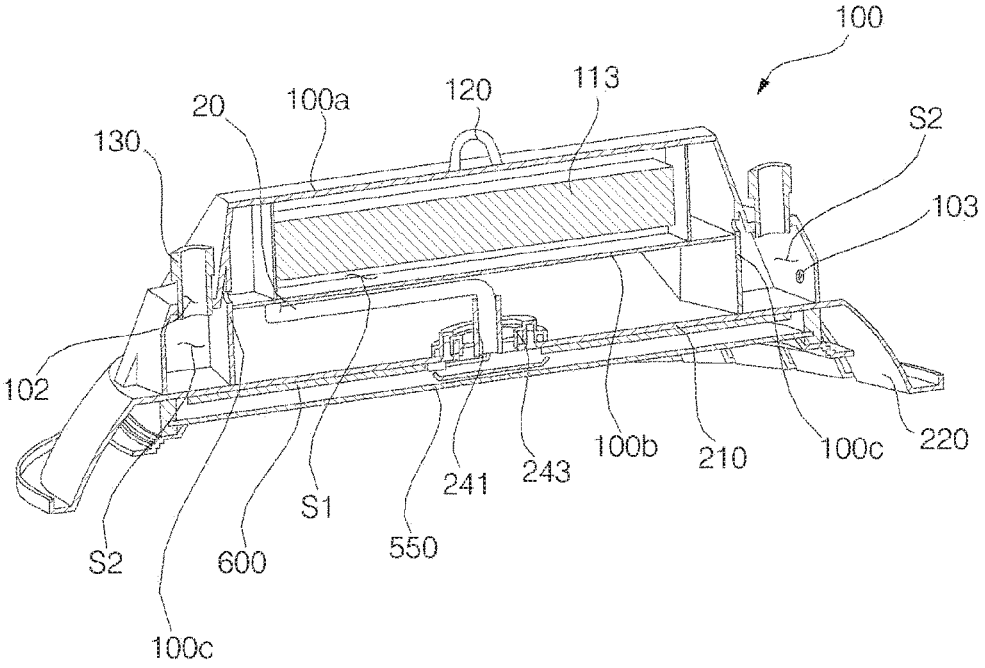
FIG. 8A is cross-sectional perspective view illustrating the lighting device according to the embodiment of the present invention.
Figure 8B:
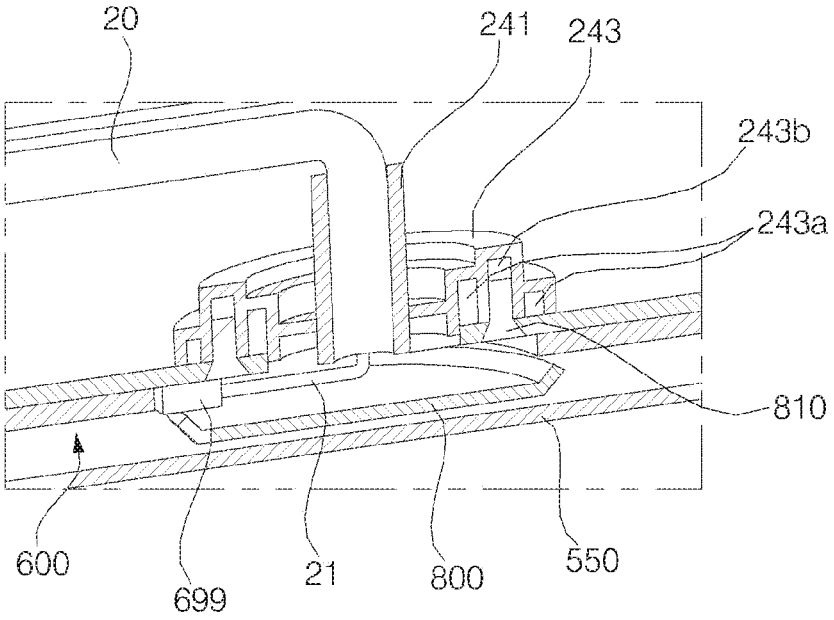
FIG. 8B is cross-sectional perspective view illustrating a portion of the lighting device according to the embodiment of the present invention.
Figure 8C:
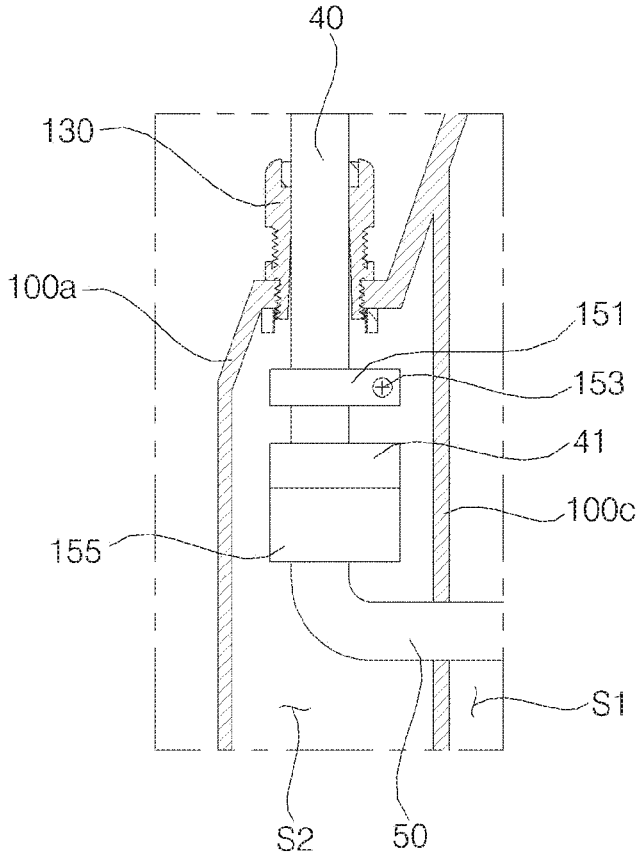
FIG. 8C is a view illustrating a junction region according to the embodiment of the present invention.

FIG. 7 is a cross-sectional view illustrating the lighting device according to the embodiment of the present invention. FIG. 8A is cross-sectional perspective view illustrating the lighting device according to the embodiment of the present invention. FIG. 8B is cross-sectional perspective view illustrating a portion of the lighting device according to the embodiment of the present invention. FIG. 8C is a view illustrating a junction region according to the embodiment of the present invention.

Referring to FIGS. 7 to 8C, the power section casing 100 is located at the upper portion of the housing 200, and allows the power unit 113 to be at least spaced apart from the housing 200.

For example, the power section casing 100 is divided into a power section region. S1 in which the power unit 113 is accommodated and at least one junction region S2 which provides a space for electrical connection of the power unit 113 and the external power source.

The power section region S1 is spaced apart from the housing 200 in the upward direction. Specifically, the junction regions S2 are located at both ends of the power section region S1 and thus the power section region S1 is spaced apart from the housing 200 by the junction regions S2. In this case, the junction regions S2 are coupled to the upper portion of the housing 200.

The power section casing 100 is divided into the power section region S1 and the junction regions S2, and the power section region S1 is spaced apart from the housing 200 by the junction regions S2. Specifically, the power section casing 100 includes an upper body 100*a* which has the power section region S1 formed at the center thereof and the junction regions S2 formed at both ends thereof, a lower body 100*b* which supports the power unit 113 and is coupled to a lower portion of the power section region S1, and partition walls 100*c* dividing the power section region S1 and the junction regions S2.

The upper body 100*a* has a shape having an opening formed at a lower portion thereof. The power section region S1 is formed at the center of the upper body 100*a* and the junction regions S2 are formed at both ends of the upper body 100*a* by two partition walls 100*c*.

The lower body 100*b* shields one region of the lower openings of the upper body 100*a* and supports the power unit 113. That is, the lower body 100*b* seals the lower portion of the power section region S1 of the upper body 100*a*. Specifically, the lower body 100*b* defines a space in which the power unit 113 is located, together with the partition walls 100*c* and the upper body 100*a*.

The junction regions S2 are located at both ends of the power section region S1 by the partition walls 100*c*. Lower ends of the junction regions S2 protrude further than a lower end of the power section region S1 in the downward direction. A lower portion of each of the junction regions S2 is one surface of the housing 200.

The power section casing 100 is coupled to the upper portion of the housing 200. Specifically, the junction regions S2 of the power section casing 100 are coupled to the upper portion of the housing 200.

The junction regions S2 provide a place in which wiring is performed. In addition, since the junction regions S2 are separate spaces from the power section region S1 in which the power unit 113 is located, a water leak from the junction regions S2 is not expanded to the power section region S1. Therefore, convenience for work space is provided.

Of course, the junction regions S2 and the power section region S1 are physical spaces, but the regions are formed with holes and the like for penetration of the cable.

In particular, referring to FIG. 8C, the power section casing 100 is formed with an external power source hole 102 (see FIG. 7) which penetrates each junction region S2 so that an external power source cable 40 passes through the external power source hole 102.

When the external power source cable 40 is inserted into the junction region S2 through the external power source hole 102, the external power source cable 40 is fixed to the external power source hole 102. Specifically, a hollow fastening member 130 which fixes the external power source cable 40 and seals the external power source hole 102 is located at the external power source hole 102.

The hollow fastening member 130 is screwed to the external power source hole 102 and the external power source cable 40 is inserted into the hollow fastening member 130. The hollow fastening member 130 has a bolt shape in which a cable passage is longitudinally formed. It is preferable that the hollow fastening member 130 includes two hollow fastening members and the two hollow fastening members are screwed to each other through the external power source hole 102.

A cable fixing section for fixing the external power source cable 40 connected to the external power source is formed in the junction region S2. The cable fixing section may have various structures as long as the external power source cable 40 inserted into the junction region S2 is fixed. Preferably, the cable fixing section includes a pressing portion 151 for pressing the external power source cable 40 and a fastening bolt 153 for fastening the pressing portion 151 to the junction region S2. An external power source connector 41 may be formed at one end of the external power source cable 40.

In addition, a ground section 155 electrically connected to the power unit 113 is formed in the junction region S2. The ground section 155 includes an electric conductor, and is connected to the power unit 113 by a cable 50. The ground section 155 is fixed in the junction region S2. Preferably, the ground section 155 may have a connector shape matched with the external power source cable 40. The ground section 155 is electrically connected to the external power source cable 40.

Since the power section casing 100 is coupled to the housing 200 and the power unit 113 is spaced apart from the housing 200, heat generated by the power unit 113 may be suppressed from being transferred to the light source module 600.

In addition, since the power section casing 100 is divided into the power section region S1 and the junction regions S2 by the partition walls 100*c*, heat transfer between the housing 200 and the power unit 113 may be delayed.

In addition, the junction regions S2 serve to perform wiring and delay heat transfer.

The light source cable 20 is fixed into the power connection hole 211 by the cable fastening member.

In particular, referring to FIG. 8B, the cable fastening member includes a female fastening member 243 which is coupled to the power connection hole 211 and has a hole formed with a thread therein, and a male fastening member 241 which is screwed to the hole of the female fastening member 243 while the light source cable 20 is inserted into the male fastening member 241.

The female fastening member 243 is screwed to an edge of the power connection hole 211 and has the hole formed with the thread therein while the male fastening member 241 is screwed to the hole. The outside of the female fastening member 243 overlaps with the edge of the power connection hole 211, and the female fastening member 243 has a thread groove 243*b* and a sealing groove 243*a* formed at an edge thereof. The bolt 810 is coupled to the thread groove 243*b* and a sealing member (not shown) for sealing the thread groove 243*b* is located at the sealing groove 243*a*.

The male fastening member 241 has a bolt shape in which a passage for pass of the light source cable 20 is formed, and is screwed to the hole of the female fastening member 243.

Here, the light source cable 20 may be a bundle of sub-cables 21. A connector 699 coupled to a connector coupling section 640 of the light source module 600 to be described later is formed at one end of the light source cable 20.

Figure 9A:
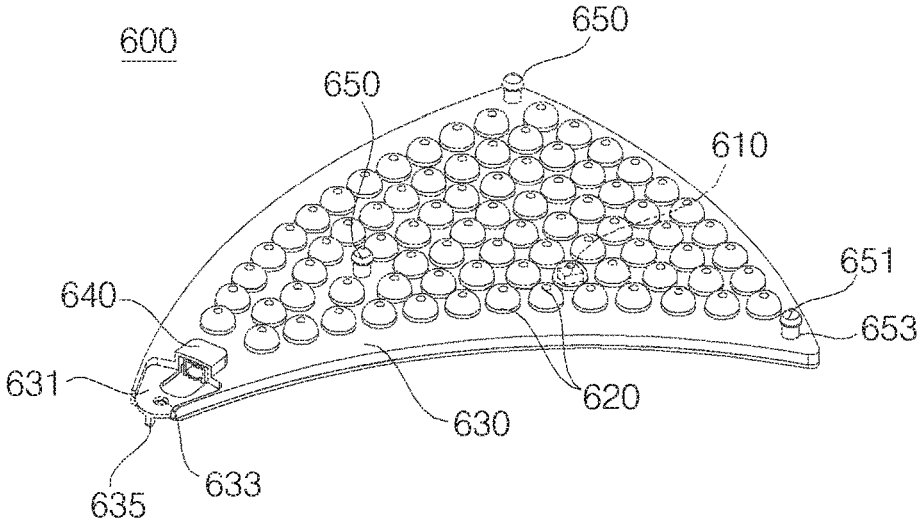
FIG. 9A is a perspective view illustrating a light source module according to the embodiment of the present invention.

FIG. 9A is a perspective view illustrating a light source module according to the embodiment of the present invention.

Referring to FIG. 9A, the light source module 600 may include all means for generating light.

For example, the light source module 600 may include a plurality of light emitting elements 610 and a support substrate 630 which supplies power to the light emitting elements 610 and supports the light emitting elements 610. However, the embodiment is not limited thereto, and a light emitting element package including the light emitting elements 610 may also be used as the light emitting elements 610.

Each of the light emitting elements 610 may be, for example, a light emitting diode. The light emitting diode may be a colored light emitting diode to emit, e.g., red, green, blue, and white light, or a UV (Ultra Violet) light emitting diode to emit ultraviolet light, but the embodiment is not limited thereto.

In addition, the light source module 600 may generate single color light and also emit white light by color mixture of light generated by the light emitting elements 610.

Each of the light emitting elements 610 may be covered by a lens 620 corresponding thereto.

The lens 620 changes optical properties of light generated by the light emitting element 610. Specifically, the lens 620 has a hemispherical shape and thus may expand an orientation angle of light generated by the light emitting element 610.

The support substrate 630 supplies power to the light emitting elements 610, and provides a space in which the light emitting elements 610 are located. For example, the support substrate 630 includes a printed circuit board. The support substrate 630 has any shape, but may have a shape in which a width thereof is gradually enlarged from one end of the support substrate 630 toward the other end thereof since one end of the light source module 600 has to be adjacent to the power connection hole 211.

In addition, the light source module 600 includes support protrusions 650, a connector coupling section 640, and a connector seating groove 631.

The support protrusions 650 are pressed by the front cover 500 to fix the light source module 600 in a space defined by the housing 200 and the front cover 500. The support protrusions 650 are supported by the front cover 500 and are pressed when the front cover 500 is coupled to the housing 200.

Accordingly, when the support protrusions 650 are used, a separate fastening member is unnecessary when the light source module 600 is coupled to the housing 200 and water introduction caused by coupling of the fastening member is prevented.

For example, the support protrusions 650 protrude from the support substrate 630. Specifically, the support protrudes 650 are formed so as to protrude further than the light emitting elements 610 (and the lenses 620) from the support substrate 630. Thereby, the light emitting elements 610 are not pressed when the front cover 500 presses the support protrusions 650.

Figure 10:
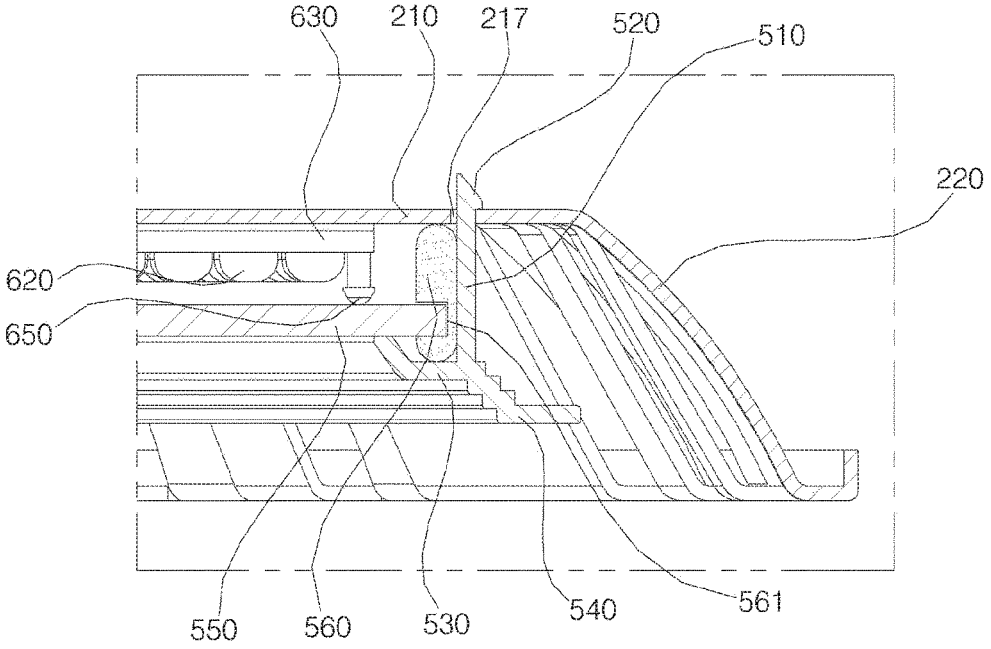
FIG. 10 is a cross-sectional view for explaining coupling of a front cover according to the embodiment of the present invention.

In more detail, the support protrusions 650 may be pressed by an optical plate 550 as shown in FIG. 10, and description thereof will be given later.

The support protrusions 650 may be elastically deformed. Specifically, each of the support protrusions 650 may include a support member 653 protruding from the support substrate 630 and an elastic member 651 which is connected to the support member 653 and is made of a material having more elasticity than the support member 653.

The connector coupling section 640 is coupled with the connector 699 connected to the light source cable 20.

The connector coupling section 640 is located at one end of the support substrate 630. Here, one end of the support substrate 630 has a small width and thus is arranged adjacent to the power connection hole 211.

In addition, the support substrate 630 includes the connector seating groove 631 to which the connector 699 is seated. In this case, the connector seating groove 631 is formed to correspond to a position of the connector 699, and may be formed by recessing the support substrate 630.

The light source positioning hole 633 may be formed in the connector seating groove 631. The light source fastening member (not shown) passing through the connector 699 passes through the light source positioning hole 633.

In addition, the light source module 600 further includes a light source fixing protrusion 635 matched with a light source fixing groove (not shown) formed on the back surface of the housing 200.

The light source module 600 is disposed on the back surface of the housing 200. Specifically, the light source module 600 is disposed on the back surface of the base plate 210.

In this case, the light source module 600 has a width gradually enlarged proceeding in a direction away from the power connection hole 211. That is, the width of the light source module 600 is gradually enlarged from one end of the light source module 600 (specifically, one end of the support substrate 630) toward the other end thereof. One end of the light source module 600 is disposed adjacent to the power connection hole 211.

Accordingly, the power connection hole 211 is surrounded by shapes of a plurality of light source modules 600, and the number of required light source modules 600 may be provided in the lighting device 10.

The light source modules 600 are radially arranged about the power connection hole 211 as a whole.

In addition, the power connection hole 211 and one end of each light source module 600 are covered by a cap 800 (see FIG. 8B). The cap 800 is inserted and coupled to the power connection hole 211.

Figure 9B:
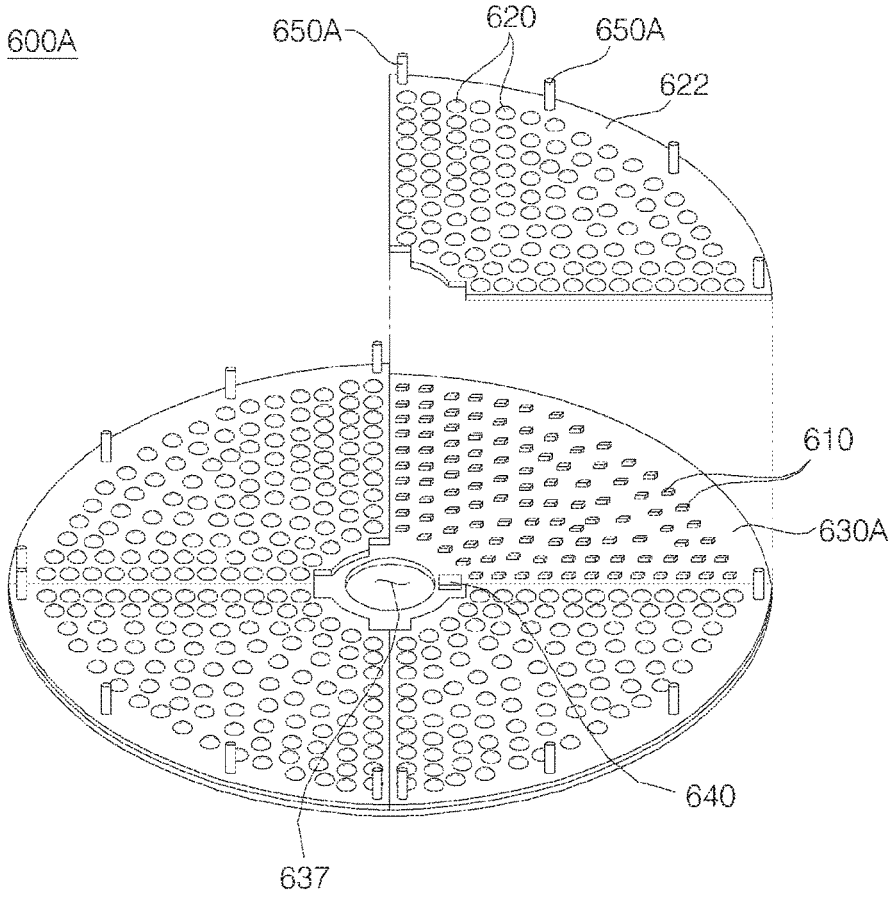
FIG. 9B is a perspective view illustrating a light source module according to another embodiment of the present invention.
Figure 9C:
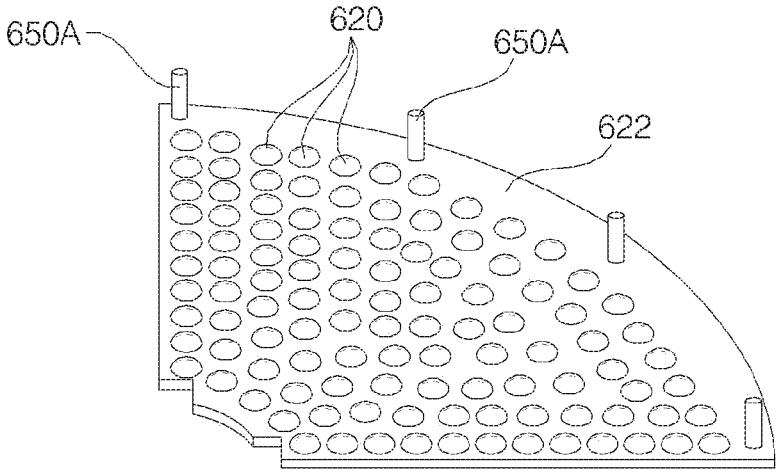
FIG. 9C is a perspective view illustrating a lens array according to another embodiment of the present invention.
Figure 9D:
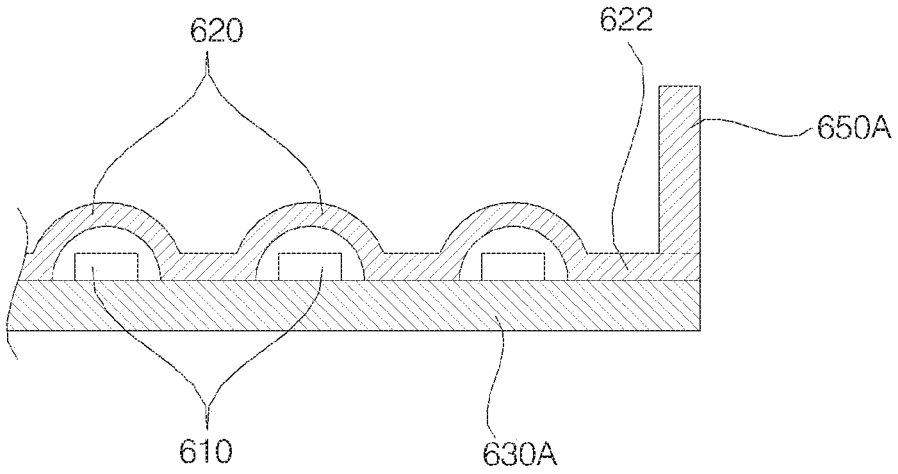
FIG. 9D is a cross-sectional view illustrating a portion of the light source module illustrated in FIG. 9B.

FIG. 9B is a perspective view illustrating a light source module according to another embodiment of the present invention, FIG. 9C is a perspective view illustrating a lens array according to another embodiment of the present invention, FIG. 9D is a cross-sectional view illustrating a portion of the light source module illustrated in FIG. 9B.

Referring to FIGS. 9B to 9D, a light source module 600A according to another embodiment differs from that of the embodiment illustrated in FIG. 9A, in terms of a lens array having a plurality of lenses 620, a shape of a support substrate 630A, and a position of a support protrusion 650A.

The support substrate 630A has a hole 637, which is formed at a center thereof and corresponds to the power connection hole 211, and has a shape corresponding to the base plate 210. Specifically, the support substrate 630A has a circular shape when viewed from below. The support substrate 630A is provided with a plurality of light emitting elements 610.

The lens array has a structure in which the lenses 620 are coupled to each other. The lens array serves to fix positions of the lenses 620 corresponding to the light emitting elements 610. For example, the lens array includes a plurality of lenses 620 and a support plate 622 on which the lenses 620 are located.

Here, the support plate 622 has any shape, but may have a shape corresponding to the shape of the support substrate 630A. The support plate 622 includes a plurality of support plates arranged to cover the support substrate 630A. For example, each of the support plates 622 has a quarter-circular shape. The support plate 622 is made of the same material as that of each lens 620.

The lenses 620 arranged on the support plates 622 are located corresponding to the light emitting elements 610.

In this case, the support protrusion 650A may be formed at each support plate 622. The support protrusion 650A protrudes from the support plate 622.

Figure 11:
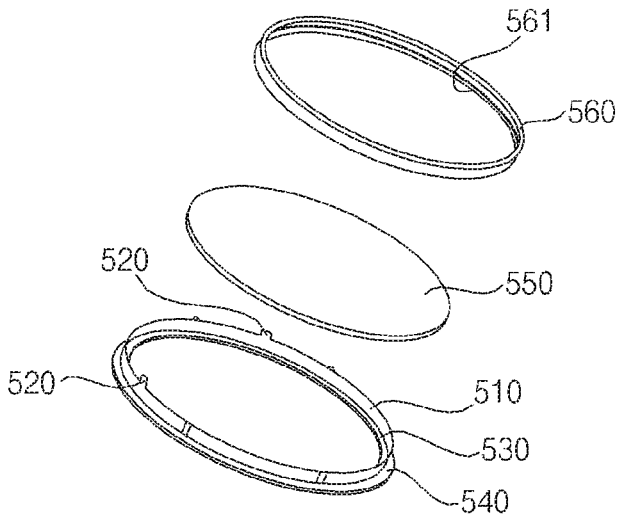
FIG. 11 is an exploded perspective view illustrating the front cover according to the embodiment of the present invention.

FIG. 10 is a cross-sectional view for explaining coupling of the front cover according to the embodiment of the present invention. FIG. 11 is an exploded perspective view illustrating the front cover according to the embodiment of the present invention.

Referring to FIGS. 10 and 11, the front cover 500 is coupled to the housing 200 and defines a space in which each light source module 600 is located. The front cover 500 transmits light generated by the light source module 600.

In addition, the front cover 500 presses the support protrusions 650 of the light source module 600 when being coupled to the housing 200, with the consequence that the light source module 600 is fastened without a fastening member.

For example, the front cover 500 is integrally formed and may have a sealing structure between a region in which the light source module 600 is located and the outside when the front cover 500 is coupled to the housing 200.

For another example, a front cover 500 may be configured of a plurality of components.

Specifically, the front cover 500 covers the base plate 210 and the lower portion of the light source module 600.

The front cover 500 includes a cover body 510, a front cover coupling member, and an optical plate 550.

The cover body 510 is formed to surround the light source module 600 and the power connection hole 211.

Specifically, the cover body 510 is disposed to surround the power connection hole 211 when viewed from below, and a space in which the light source module 600 is located is defined between the cover body 510 and the power connection hole 211.

In more detail, the cover body 510 has a ring shape. In addition, the cover body 510 has an expansion section 540 formed at a lower portion thereof to be expanded outward.

The expansion section 540 guides light generated by the light source module 600.

In addition, the front cover 500 further includes a sealing ring seating section 530 to which a sealing ring 560 (or the optical plate 550) to be described later is seated. The sealing ring 560 is seated to the sealing ring seating section 530.

Specifically, the sealing ring seating section 530 extends inward from the cover body 510. That is, the sealing ring seating section 530 has a ring shape extending inward from the cover body 510. In addition, the sealing ring seating section 530 has an end bent upward so as to prevent the seated sealing ring 560 from being decoupled therefrom.

The front cover coupling member couples the cover body 510 to the housing 200. For example, the front cover coupling member includes a hook 520 which is coupled through the hook hole 217 formed in the housing 200. The hook 520 may include a plurality of hooks arranged in a circumferential direction of the cover body 510.

Specifically, the hooks 520 protrude upward from the cover body 510.

For another example, a front cover coupling member may be a bolt (not shown) which is fastened through the housing 200 and the cover body 510.

The optical plate 550 covers the lower portion of the light source module 600 and changes optical properties of the light source module 600. In addition, the optical plate 550 covers the lower portion of the light source module 600 to protect the light source module 600 from the outside.

For example, the optical plate 550 may diffuse light incident on the light source module 600 as surface light.

The optical plate 550 has scattered particles therein for scattering light incident on the light source module 600, and may convert point light incident on the light source module 600 into surface light.

In accordance with the embodiment, the optical plate 550 may be used by manufacturing PMMA (polymethylmethacrylate) or transparent acrylic resin as a flat or wedge type, and may be made of a glass material. In addition, the optical plate 550 may be a plastic material, but the embodiment is not limited thereto.

Specifically, the optical plate 550 may have a plate or film shape.

Preferably, the optical plate 550 may be made of a synthetic resin material having certain stiffness and ductility and high processability.

In addition, the optical plate 550 is formed so as to correspond to the shape and size of a region in which the light source module 600 is located. That is, the optical plate 550 may have a shape fitted inside the cover body 510.

The optical plate 550 presses the support protrusions 650 when the front cover 500 is coupled to the housing 200.

In order to prevent water or foreign substances from being introduced into the light source module 600 from the outside, the front cover 500 may further include the sealing ring 560.

The sealing ring 560 seals between a space in which the light source module 600 is located and the outside. Specifically, the sealing ring 560 seals between the space defined by the cover body 510 in the lower surface of the base plate 210 and the outside. In addition, the sealing ring 560 is coupled to the optical plate 550 to seal between the inner portion and the outer portion of the optical plate 550.

Specifically, the sealing ring 560 has a ring shape so as to be seated to the sealing ring seating groove 530. The edge of the optical plate 550 is fitted to the sealing ring 560 in the internal space. For example, an inner surface of the sealing ring 560 is recessed outward so that a ring groove 561 is formed, and the edge of the optical plate 550 is fitted to the ring groove 561.

Accordingly, the region of the base plate 210 in which the light source module 600 is located may be sealed from the outside by the sealing ring 560.

In this case, the front cover coupling member is located outside a closed space defined by the sealing ring 560, and thus water or the like introduced from the front cover coupling member is further prevented from infiltrating into the light source module 600.

Figure 12:
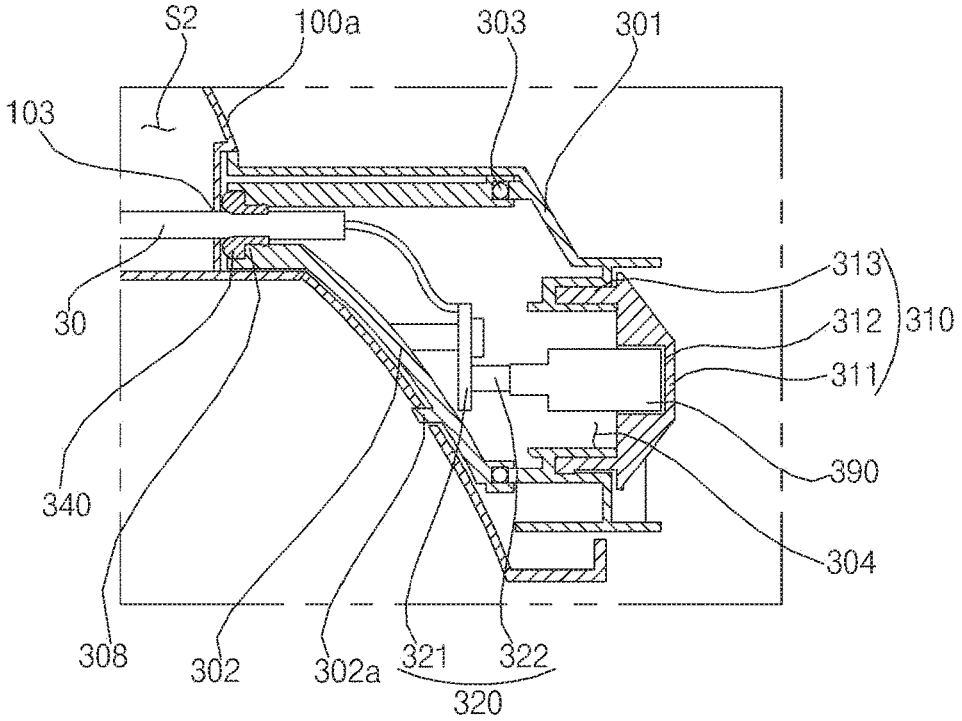
FIG. 12 is a cross-sectional view illustrating an auxiliary casing according to the embodiment of the present invention.
Figure 13:
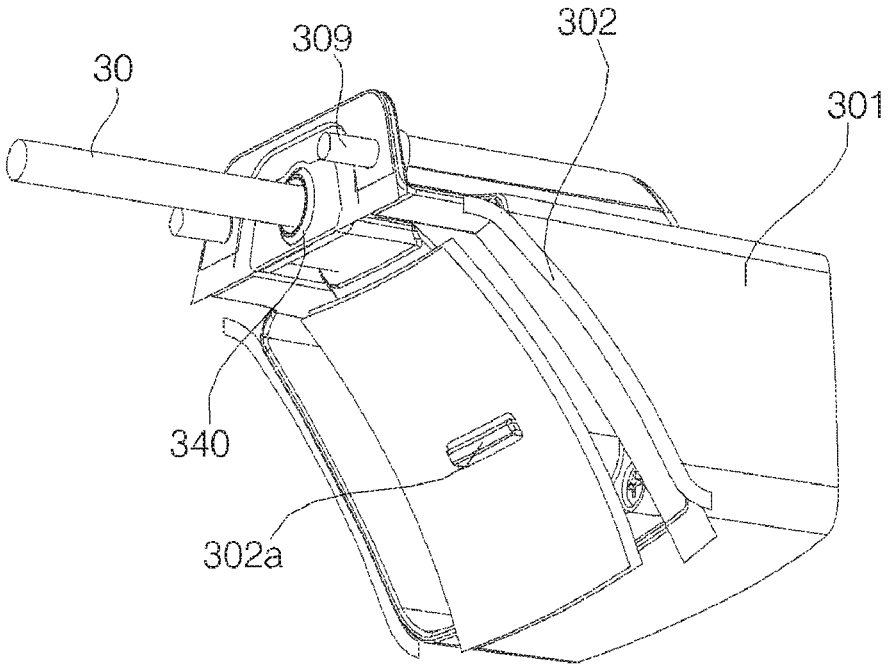
FIG. 13 is perspective view illustrating the auxiliary casing according to the embodiment of the present invention.
Figure 14:
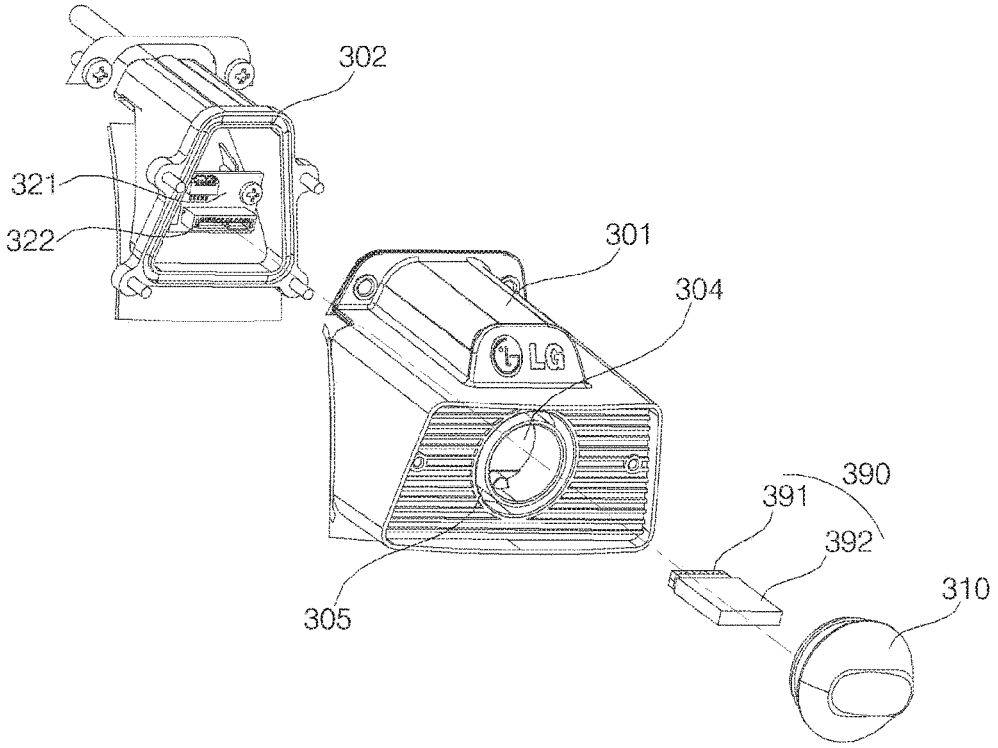
FIG. 14 is an exploded perspective view illustrating the auxiliary casing according to the embodiment of the present invention.

FIG. 12 is a cross-sectional view illustrating an auxiliary casing according to the embodiment of the present invention. FIG. 13 is perspective view illustrating the auxiliary casing according to the embodiment of the present invention. FIG. 14 is an exploded perspective view illustrating the auxiliary casing according to the embodiment of the present invention.

Referring to FIGS. 12 to 14, an auxiliary casing 300 according to the embodiment provides a space for accommodating the auxiliary connector 320 electrically connected to the power unit 113, and an inner portion of the auxiliary casing 300 is sealed.

Here, the auxiliary unit 390 includes one of a communication module, a sensor module, and a control module. The auxiliary unit 390 includes a module body 392 and a connection terminal 391 electrically connected to the module body 392.

The auxiliary casing 300 allows the communication module and the sensor module for providing control signals or communication signals to the power unit to be easily replaced, and prevents introduction of water from the outside. In addition, when the auxiliary unit 390 is a communication module, the auxiliary casing 300 smoothly transmits radio waves supplied to the communication module.

The auxiliary casing 300 may be configured of one component, but is preferably configured of two components for convenience of assembly.

The auxiliary casing 300 may be coupled to the junction region S2 and/or the heat dissipation section 220. Preferably, an upper portion of the auxiliary casing 300 is coupled to the junction region S2 and a lower portion of the auxiliary casing 300 is coupled to the heat dissipation section 220. In this case, a fastening bolt 309 is fastened to the junction region S2 through the upper portion of the auxiliary casing 300. A positioning protrusion 302*a* matched with a position hole 260 (see FIG. 4) formed at the heat dissipation section 220 is formed in the auxiliary casing 300. Specifically, the positioning protrusion 302*a* is formed in the lower portion of the auxiliary casing 300.

For example, the auxiliary casing 300 is formed by coupling of first and second casings 302 and 301. A space for accommodating of the auxiliary connector 320 electrically connected to the power unit 113 is defined between the first and second casings 302 and 301. The first and second casings 302 and 301 are sealed by a casing sealing member 303.

The auxiliary connector 320 is connected to the power unit 113 by an auxiliary cable 30. The auxiliary connector 320 is fixed to the auxiliary casing 300. Specifically, the auxiliary connector 320 includes an actuating substrate 321 and a coupling terminal 322 coupled to the connection terminal 391 of the auxiliary unit 390. The auxiliary cable 30 is preferably connected to the power unit 113 via the junction region S2.

In this case, a tube connection section 308 into which the auxiliary cable 30 is inserted is formed in the auxiliary casing 300. The tube connection section 308 and the auxiliary cable 30 are sealed by an auxiliary sealing ring 340.

The tube connection section 308 has a hole shape for passage of the auxiliary cable 30, and the auxiliary sealing ring 340 seals between the tube connection section 308 and the auxiliary cable 30 and between the tube connection portion 308 and the junction region S2 of the power section casing 100. That is, the auxiliary sealing ring 340 comes into contact with an inner surface of the tube connection section 308, an outer surface of the auxiliary cable 30, and the junction region S2.

An auxiliary cable hole 103 through which the auxiliary cable 30 passes may be formed in the junction region S2. In this case, the auxiliary sealing ring 340 comes into contact with the junction region S2 around the auxiliary cable hole 103.

Meanwhile, the auxiliary casing 300 further includes an insertion tunnel 304 and an auxiliary cover 310.

The insertion tunnel 304 is a hole through which the auxiliary unit 390 coupled to the auxiliary connector 320 passes. The insertion tunnel 304 is formed at a position corresponding to the auxiliary connector 320, and has a size large enough to pass the auxiliary unit 390 through the insertion tunnel 304.

In this case, an auxiliary cover groove 305 in which the auxiliary cover 310 is inserted is formed in the auxiliary casing 300. The auxiliary cover groove 305 is formed around the insertion tunnel 304 so as to surround the insertion tunnel 304. Specifically, the auxiliary cover groove 305 is formed around the insertion tunnel 304 by recessing the auxiliary casing 300 toward the inside from the outside.

The auxiliary cover 310 seals the insertion tunnel 304. In addition, the auxiliary cover 310 has elasticity and is made of a rubber or resin material for penetration of radio waves. For example, the auxiliary cover 310 include a cover body 311 for covering at least the insertion tunnel 304 and a cover ring 313 inserted into the auxiliary cover groove 305.

The auxiliary cover 310 has an accommodation section 312 for accommodating the auxiliary unit 390. Specifically, one end of the auxiliary unit 390 is accommodated in the accommodation section 312. Accordingly, when the auxiliary unit 390 is a communication module, smooth communication with external communication devices is possible. In this case, the auxiliary unit 390 may be located immediately above the heat dissipation section 220 of the housing 200.

In accordance with the embodiments of the present invention, since the power section casing is coupled to the housing and the power unit is spaced apart from the housing, heat generated by the power unit may be suppressed from being transferred to the light source module.

In addition, since the power section casing is divided into the power section region and the junction region by the partition wall, heat transfer between the housing and the power unit may be delayed and wiring may be easily performed.

In addition, since the auxiliary casing is separately formed immediately above the heat dissipation section of the housing, the auxiliary unit may be easily replaced and communication of the auxiliary unit may be easily performed.

In addition, since the auxiliary cover is used, the auxiliary unit may be easily replaced and the inner portion of the auxiliary casing may be waterproofed.

In addition, lighting in a desired form of power consumption may be easily realized by changing the number of light source modules coupled to the housing.

In addition, since the lighting device has a structure in which the front cover presses the support protrusions protruding from the support substrate, a separate fastening member may be unnecessary when the light source module is coupled to the housing and water introduction caused by coupling of the fastening member may be prevented.

In addition, since the lighting device has the heat dissipation section for increasing a contact time between the housing and air, heat transferred to the housing may be efficiently dissipated.

As is apparent from the above description, in a lighting device according to exemplary embodiments of the present invention, since a power section casing is coupled to a housing and a power unit is spaced apart from the housing, heat generated by the power unit may be suppressed from being transferred to a light source module.

In addition, since the power section casing is divided into a power section region and a junction region by a partition wall, heat transfer between the housing and the power unit may be delayed and wiring may be easily performed.

In addition, since an auxiliary casing is separately formed immediately above a heat dissipation section of the housing, an auxiliary unit may be easily replaced and communication of the auxiliary unit may be easily performed.

In addition, since an auxiliary cover is used, the auxiliary unit may be easily replaced and an inner portion of the auxiliary casing may be waterproofed.

In addition, lighting in a desired form of power consumption may be easily realized by changing the number of light source modules coupled to the housing.

In addition, since the lighting device has a structure in which a front cover presses a support protrusion protruding from a support substrate, a separate fastening member may be unnecessary when the light source module is coupled to the housing and water introduction caused by coupling of the fastening member may be prevented.

In addition, since the lighting device has a heat dissipation section for increasing a contact time between the housing and air, heat transferred to the housing may be efficiently dissipated.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lighting device comprising:

a housing;

at least one light source module disposed at a lower side of the housing;

a power section casing located at an upper side of the housing; and a power unit provided within the power section casing, the power unit configured to control and supply power to the light source module, wherein the power section casing is divided into a power section region for accommodating the power unit and at least one junction region for providing a space in which the power unit is electrically connected to an external power source, wherein the junction region comprises a cable fixing section therein for fixing an external power source cable connected to an external power source, and a ground section therein electrically connected to the power unit, wherein the junction regions are located at both ends of the power section region, wherein the junction regions are coupled to the upper side of the housing, and wherein the power section region is spaced apart from the upper side of the housing.

2. The lighting device according to claim 1, wherein the power section casing comprises:

an upper body having the power section region located at a center of the upper body and the junction regions located at both ends of the upper body;

a lower body supporting the power unit and coupled to a lower portion of the power section region; and partition walls dividing the power section region and the junction regions.

3. The lighting device according to claim 2, wherein a lower portion of each junction region comprises a portion of the upper side of the housing.

4. The lighting device according to claim 1, wherein the power section casing includes an external power source hole located at the junction region, the external power source hole configured to receive an external power source cable passing through the external power source hole, and wherein the lighting device further comprises a hollow fastening member threadably attached to the external power source hole, the hollow fastening member configured to receive an external power source cable passing through the hollow fastening member.

5. The lighting device according to claim 2, wherein the housing comprises:

a base plate adjacent which the light source module is located;

a heat dissipation section located at a perimeter of the base plate; and a power connection hole located at a center of the base plate, the power connection hole configured to permit a light source cable connecting the light source module to the power unit to pass through the power connection hole.

6. The lighting device according to claim 5, further comprising:

a female fastening member coupled to the power connection hole, the female fastening member having a hole with a thread therein; and a male fastening member threadably attached to the hole of the female fastening member, wherein the light source cable is inserted into the male fastening member.

7. The lighting device according to claim 5, wherein the light source module comprises:

a support substrate; and a plurality of light emitting elements protruding from the substrate.

8. The lighting device according to claim 7, further comprising a front cover coupled to the lower side of the housing to define a space in which the light source module is located, the front cover configured to permit light generated by the light source module to pass therethrough, wherein the light source module further comprises a support protrusion protruding from the support substrate, and wherein the front cover presses against the support protrusion when the front cover is coupled to the housing to support the light source module.

9. The lighting device according to claim 8, wherein the support protrusion is elastically deformable between the front cover and the support substrate.

10. The lighting device according to claim 8, wherein the front cover comprises:

a cover body surrounding the light source module;

a front cover coupling member coupling the cover body to the housing; and an optical plate covering a lower portion of the light source module, the optical plate configured to change optical properties of light generated by the light source module.

11. The lighting device according to claim 10, further comprising a hook hole provided in the housing, wherein the front cover coupling member comprises a hook coupled through the hook hole in the housing.

12. The lighting device according to claim 10, wherein the cover body includes an expansion section at a lower portion of the cover body and extending outwardly from the cover body, the expansion section configured to guide light generated by the light source module.

13. The lighting device according to claim 11, wherein the front cover further comprises:

a sealing ring to which an edge of the optical plate is fitted, the sealing ring being located inwardly of the cover body; and a sealing ring seating section for seating the sealing ring on the front cover.

14. The lighting device according to claim 13, wherein the front cover coupling member is located outside of a closed space defined by the sealing ring.

15. The lighting device according to claim 1, further comprising an auxiliary casing for accommodating an auxiliary connector electrically connected to the power unit, wherein the auxiliary casing comprises:

an insertion tunnel through which an auxiliary unit coupled to the auxiliary connector passes; and an auxiliary cover for sealing the insertion tunnel.

16. The lighting device according to claim 15, wherein the auxiliary connector and the power unit are interconnected by an auxiliary cable, and wherein the auxiliary casing further comprises:

a tube connection section in which the auxiliary cable is inserted, and an auxiliary sealing ring for sealing between the tube connection section and the auxiliary cable.

17. The lighting device according to claim 15, wherein the auxiliary cable is connected to the power unit via each junction region.

18. The lighting device according to claim 15, wherein the auxiliary casing further comprises an auxiliary cover groove located around the insertion tunnel so as to surround the insertion tunnel, and wherein the auxiliary cover is located in the auxiliary cover groove.

19. The lighting device according to claim 18, wherein the auxiliary cover comprises:

a cover body for covering at least the insertion tunnel; and a cover ring located in the auxiliary cover groove.

* * * * *